United States Patent [19]

Quiogue

[11] Patent Number: 4,907,139

[45] Date of Patent: Mar. 6, 1990

[54] PHOTOCONTROL DEVICE FOR GRADE MOUNTED LIGHT FIXTURE

[75] Inventor: Honesto D. Quiogue, Blacksburg, Va.

[73] Assignee: Hubbell Incorporated, Orange, Conn.

[21] Appl. No.: 176,318

[22] Filed: Mar. 31, 1988

[51] Int. Cl.[4] ..... F21V 23/04

[52] U.S. Cl. ..... 362/153; 362/276; 362/802; 250/214 AL

[58] Field of Search ..... 362/153, 276, 802, 805; 250/214 AL

[56] References Cited

U.S. PATENT DOCUMENTS

| | | | |
|---|---|---|---|
| 2,038,506 | 4/1936 | Cadieux | 362/153 X |
| 2,631,247 | 3/1953 | Shaw | 362/276 X |
| 3,264,466 | 8/1966 | Bacon . | |
| 3,274,392 | 9/1966 | Harling | 250/239 |
| 3,543,099 | 11/1970 | Turner | 250/226 |
| 3,880,528 | 4/1975 | Petersen et al. | 250/239 |
| 4,207,464 | 6/1980 | Fukuyama et al. | 250/239 |
| 4,343,032 | 8/1982 | Schwartz | 362/802 X |
| 4,382,274 | 5/1983 | DeBacker et al. | 362/153 |
| 4,791,290 | 12/1988 | Noone et al. | 250/214 AL X |

*Primary Examiner*—Ira S. Lazarus
*Assistant Examiner*—Peggy Neils
*Attorney, Agent, or Firm*—Jerry M. Presson; Alfred N. Goodman; Mark S. Bicks

[57] ABSTRACT

A light fixture has a light-transparent cover at substantially grade level and a photocontrol device with a self-flushing outer surface for preventing accumulation of opaque material thereon. The light fixture is adapted to be positioned within a recess in the graded environment and includes a housing which encloses a lamp electrically connected to the photocontrol device. The self-flushing outer surface of the photocontrol device discourages the build-up of opaque material so that the photocontrol device can reliably detect changes in the ambient light conditions outside the light fixture and operate the lamp in response to the detected changes.

23 Claims, 2 Drawing Sheets

PHOTOCONTROL DEVICE FOR GRADE MOUNTED LIGHT FIXTURE

FIELD OF THE INVENTION

The invention relates to a photocontrol device for controlling the lamp operation of a grade-mounted outdoor light fixture. Overlying the lamp is a cover substantially flush with the surrounding landscape, while the remainder of the light fixture is recessed below the landscape grade. A light-transmitting plug transmits ambient light to a photocontrol switch which turns the fixture lamp on and off in response to changes in the ambient light conditions. The upper surface of the plug is self-flushing to prevent accumulation of light-blocking materials thereon and is also substantially flush with the landscape grade.

BACKGROUND OF THE INVENTION

Grade-mounted light fixtures perform a variety of desirable functions, such as illuminating the facades and exteriors of buildings, creating aesthetic light and shadow effects in a range of architectural and landscape settings and providing safety and security lighting around commercial and industrial buildings. Such light fixtures are referred to as grade-mounted because, they are installed into recesses in the landscapes adjacent the buildings so that the uppermost surface of the light fixture, which is typically a transparent cover overlying the lamp, is generally flush with the landscape surface. It can be appreciated that such recessed light fixtures are ideal in environments in which lighting is desired without the unsightliness or disruptive lines of an above-grade light fixture.

In view of their installation into recesses in the landscape, recessed light fixtures require special consideration in their design and construction. For example, the light fixture must be as water tight as possible to avoid the corrosive effect of soil, plants, concrete or other material having an appreciable moisture content. Protection against water penetration is all the more important since visual inspection of such recessed light fixtures usually necessitates withdrawal of the fixture from its recess, a time-consuming and labor-intensive task. Additionally, the very low profile of the recessed light fixtures makes it difficult to successfully adapt these fixtures with desirable modifications such as, for example, photosensitive devices which detect changes in the ambient light conditions and automatically activate and deactivate the lamp without the need for operator intervention. In fact, a number of commercially available photosensitive devices have proven to be impractical or unreliable in their application to the unique environment of recessed light fixtures.

Conventional photosensitive devices generally comprise a switch having a light sensitive diode which generates electrical signals in response to the intensity of light incident upon its detecting means and a light transmitting channel or plug which channels outside light to the photosensitive switch.

One commercially available button type photocontrol device has a sensor cell mounted on a rectangular plastic housing, an arrangement much like a dish on a table top. The sensor cell faces towards the sky, while the bottom of the box rests on the fixture housing. In another commercially available photosensitive device, the housing has an integral threaded, hollow stem which can be threaded directly into a threaded aperture of the fixture housing. A third type of commercially available photosensitive device has a cylindrical housing with a threaded hollow stem for engagement with the aperture of the fixture housing.

However, as can be appreciated, these outer mounted photocontrol devices are ill suited for recessed light fixtures. The flat surface of the sensor cells which receive the ambient light can easily be blocked by dirt, dust, plant debris or other opaque materials which collect thereon. With the sensor cell partially or completely blocked by the accumulated materials, only a significantly reduced amount of ambient light passes through the sensor cell to fall onto and activate the photosensitive diode in the switch. Eventually, when the amount of ambient light falling through to the switch is beneath a preset threshold, the switch responds as if dark conditions prevail outside the light fixture and thus acts to turn on the lamp. As can be seen, such "false reading" by the photocontrol device can waste energy nd unnecessarily reduce the operating life of the lamp and the other light fixture components by turning on the lamp when diminished or dark light conditions do not, in fact, exist.

Additionally, in recessed light fixture applications, it is desirable that the switch be beneath the exterior surface of the landscape grade so the smooth, grade level appearance of the fixture is maintained. In addition to marring the aesthetic appearance of the grade-mounted light fixture, these known photosensitive devices can interfere with pedestrians walking over the outer surface of the fixture or with lawn mowers or other landscape maintenance machines which pass over the light fixture.

The interference problems caused by the excessive height of the known photocontrol devices can be reduced if the switch component of the photosensitive devices is disposed beneath the outer surface of the fixture while the light channeling plug is the sole component which projects above the outer surface of the light fixture. It is known to dispose the switch components of photosensitive devices within the housing of a light fixture while positioning the light collecting plug on the exterior of the housing. For example, see U.S. Pat. No. 3,264,466 to Bacon, Jr., U.S. Pat. No. 3,274,392 to Harling and U.S. Pat. No. 3,543,099 to Turner. These patents are directed to photosensitive devices disposed within street lamps or other light fixtures positioned some distance above ground. However, while these patents disclose light collecting plugs which prevent, to some degree, the accumulation of dirt or other opaque material on their outer surface — see, for example, the dome shaped collectors of Bacon and Turner and the conical light collector of Harling — these patents offer little guidance to the successful adaptation of a photosensitive device to a grade mounted or recessed light fixture. For example, the conical light collector of Harling is angled so that a desirable amount of light rays are reflected by the reflective surface of the collector onto the underlying photosensitive cell. Thus, the height to which the conical collector projects above the light fixture housing is not a design constraint as it is with received light fixtures.

SUMMARY OF THE INVENTION

It is an object of the invention to provide an outdoor grade-mounted fixture having a photocontrol device which minimizes the accumulation of light-blocking materials on its light-transmitting plug while having its uppermost part at substantially grade level.

It is a further object of the invention to provide a recessed lighting fixture having a photocontrol device which has a minimum height above grade level so as to minimize interference with pedestrians and landscape maintenance equipment.

It is yet a further object of the invention to provide a photocontrol device for a recessed lighting fixture which is easily installed.

It is yet an additional object of the invention to provide a photocontrol device for a recessed lighting fixture which can be sealed in a water-tight manner with the fixture without the need for extensive sealing hardware.

It is yet another object of the invention to provide a photocontrol device for a recessed lighting fixture having a plug which is a single piece and which can be readily installed to the fixture.

It is yet another object of the invention to provide a recessed lighting fixture in which the switch of the photocontrol device can be positioned beneath the outer surface of the light fixture.

It is yet an additional object of the invention to provide a photocontrol device for a recessed lighting fixture which is not readily susceptible to breaking or bending when impacted by moving objects such as a shoe or landscape maintenance equipment.

The foregoing objects are accomplished by a light fixture positionable in a recess in a graded environment, comprising a housing, located in the recess, having an outer top surface located substantially at grade level and including first and second apertures. A light-transparent lens is coupled to the housing in the first aperture. A lamp is mounted within the housing for directing light through the cover. A photocontrol device is operatively connected to the lamp for operating the lamp in response to changes in the ambient light conditions outside the light fixture. The photocontrol device includes a light-transparent member coupled to the housing in the second aperture, the member having an outer surface including self-flushing means for preventing accumulation of opaque material thereon, and a photosensitive switch coupled to the housing for receiving ambient light passing through the light-transparent member and having means for electrically connecting the switch to the lamp.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF PREFERRED EMBODIMENTS

Figure 3:
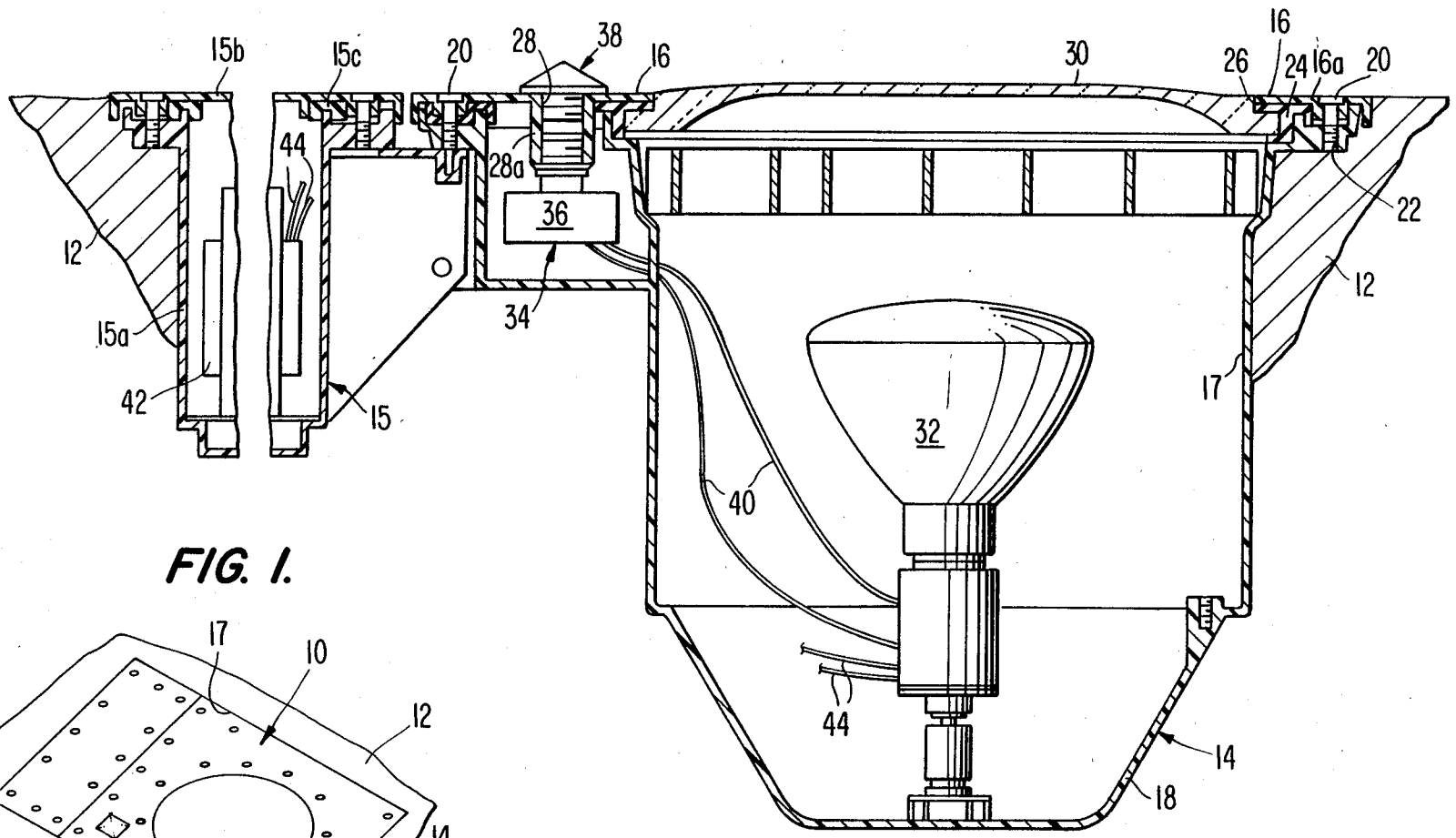
FIG. 3 is a side elevational view in section of the recessed lighting fixture shown in FIGS. 1 and 2, taken along line 3—3 of FIG. 2.
Figure 1:
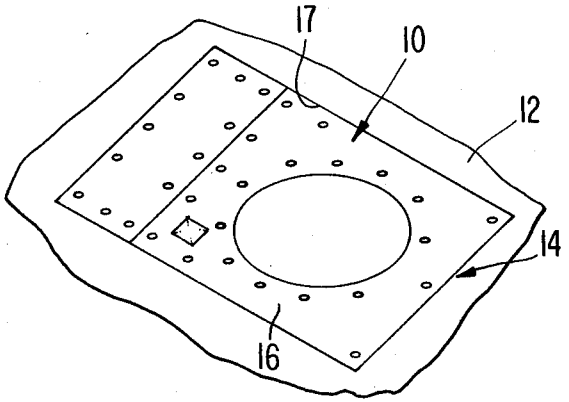
FIG. 1 is a perspective view of a recessed light fixture of the present invention, shown installed in a landscape environment and having a light-transmitting plug and a light-transparent lamp lens substantially at grade level.
Figure 2:
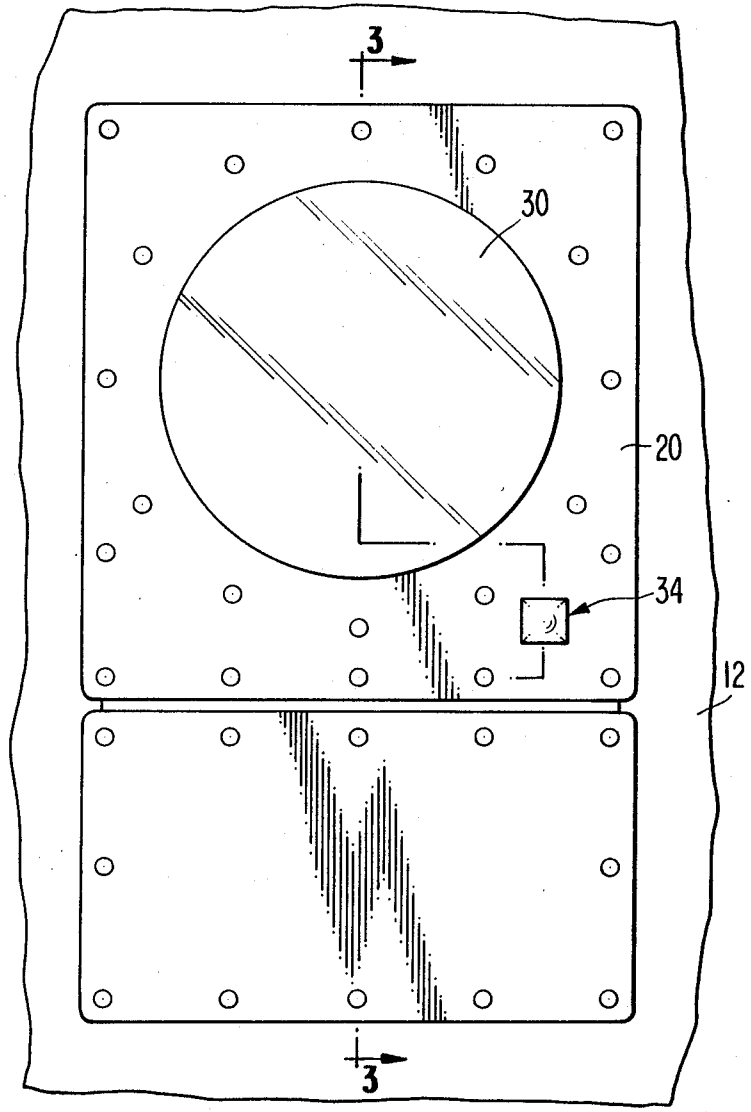
FIG. 2 is an enlarged top plan view of the outer surface of the recessed light fixture of FIG. 1.

Light fixture 10 in accordance with the invention is shown in FIGS. 1, 2 and 3 in a graded landscape environment 12. Light fixture 10 includes a lamp housing 14 and a ballast housing 15 having an outer top surface 16. The fixture is mounted within a recess 17 of landscape environment 12 such that outer top surface 16 is substantially at the level of the surrounding top surface of landscape environment 12.

As seen in FIGS. 1-3, housing 14 encloses the various components of light fixture 10 and has continuous, water-tight housing base 18 which forms a protective, water-tight barrier between the internal electrical components of light fixture 10 and the surrounding soil of landscape environment 12. A housing cover **16*a* is secured to housing base 18 by fasteners 20. The fasteners pass through apertures in cover 16*a* and threadedly engage internally threaded holes 22 of housing base 18. A gasket 24 is disposed between the under side of cover 16*a* and housing base 18 so that moisture cannot penetrate at the interface between the cover 16*a* and housing base 18**.

Ballast housing 15 has a housing base **15*a* and a cover 15*b*. A gasket 15*c* seals cover 15*b* and housing base 15*a*. The ballast housing 15 is separately formed from lamp housing 14 and is coupled to housing 14** by fasteners.

Cover **16*a* includes a first aperture 26 and a second aperture 28. A transparent lens 30 is sealingly disposed in first aperture 26 and is positioned to overlie a lamp 32 supported on the inside of housing 14. Light from lamp 32 is transmitted through transparent lens 30** to illuminate the outside environment.

A photocontrol device 34 for operating lamp 32 in response to changes in the ambient light conditions includes a switch 36 disposed beneath cover **16*a* and a plug 38 threadably received in second aperture 28. Wires 40 connect photo-control device 34 and lamp 32 so that the lamp is electrically activated in response to changes in ambient light conditions detected by photocontrol device 34. A transformer 42 (partially shown in FIG. 3) supplies power to lamp 32 via wires 44. A cable connects transformer 42** to a power source (not shown).

Housing 14 is advantageously constructed of fiberglass reinforced polyester composite. This material offers desirable strength and high resistance to corrosion, and is light weight for easy installation. Material of high strength is desirable, for example, so that outer surface 16 formed by cover **16*a* resists deformation when stepped on and so that housing base 18 resists deformation from dirt or gravel compacted against it. Housing 14 is advantageously designed to enclose the components of light fixture 10 in as small a volume as possible so that light fixture 10 can be fitted in a wide variety of large and small recesses in a landscape environment 12**.

Transparent lens 30 is advantageously crowned or slightly convex to promote run off of water, dirt and other materials. The transparent lens 30 is advantageously constructed of borosilicate or tempered glass to resist exposure to weather elements, pedestrian traffic, landscape maintenance equipment and other impact and wear forces. Gasket 24, suitably constructed of water resistant material such as single piece molded silicone, is also disposed between transparent lens 30 and cover **16*a* to seal first aperture 26** against water penetration.

Fasteners 20 are advantageously constructed of stainless steel to resist corrosion and are tamper resistant to prevent unauthorized access to light fixture 10.

Switch 36 of photocontrol device 34 has an externally threaded stem 50 which threadably engages second aperture 28. The core of stem 50 is transparent to permit light from plug 38 to enter switch 36.

Figure 4:
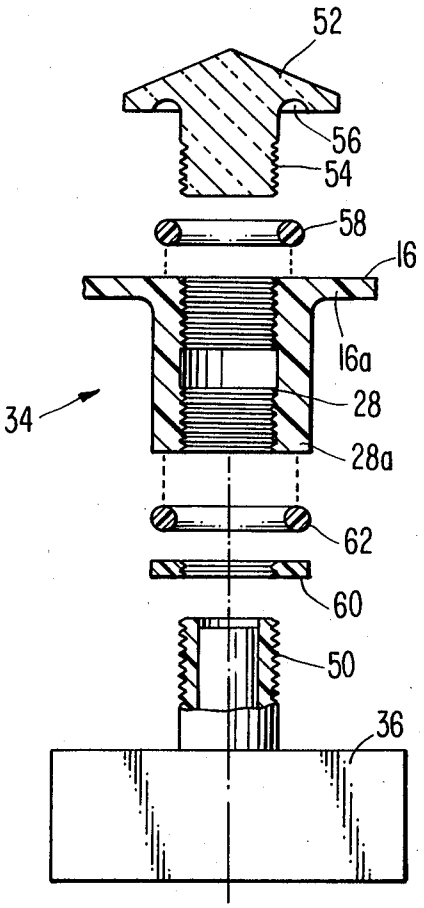
FIG. 4 is an exploded, enlarged side elevational view, partially in the section, of the photocontrol device of the recessed light fixture of FIG. 1.

As best seen in FIG. 4, plug 38 is preferably constructed as a single unit of clear thermoplastic material and comprises a generally conical outer top surface 52 and an externally threaded post 54 threaded into second aperture 28. Second aperture 28 is defined in a generally cylindrical member **28*a* depending from cover 16*a*. An annular groove 56 having a diameter lightly larger than the diameter of post 54 receives an 0-ring 58. The 0-ring compressed against outer surface 16 when plug 38 is threaded into second aperture 28, thereby providing a water tight seal between plug 38 and second aperture 28. Additional protection against water penetration through aperture 28 is provided by an arrangement comprising nut 60 and a second O-ring 62 disposed around stem 50. Nut 60 is threadable along stem 50 to compress O-ring 62 against the bottom end of cylindrical member 28*a*. O-ring 62** forms a water tight seal when compressed.

Outer surface 52 of plug 38 is self-flushing — i.e., the surface is downwardly inclined so that dirt and debris tends to slide off the plug, especially when mixed with water. The self-flushing shape of outer surface 52 minimizes the accumulation of dirt, debris and other opaque material which inevitably accumulates on recessed light fixtures. The accumulation of opaque material on the plug can so limit the ambient light reaching the underlying switch of the photocontrol device that the device wrongly "interprets" the lack of ambient light as indicative of dark light conditions outside the light fixture. The photocontrol device would then operate the lamp in an untimely manner.

As best seen in FIG. 3, the height to which outer surface 52 projects above outer surface 16 is relatively small and preferably on the order of less than ½ inch. By comparison, several commercially available photocontrol devices adaptable to recessed light fixtures typically project more than 2 inches above the light fixture. The reduced height of plug 38 minimizes interference with pedestrian traffic on light fixture 10 and minimizes the risk that plug 38 will be damaged by landscape maintenance equipment.

Although outer surface 52 of plug 38 is conical, the surface can be of any self-flushing shape such as, for instance, a ramp or wedge shape.

While various embodiments have been chosen to illustrate the invention, it will be understood by those skilled in the art that various changes and modifications can be made therein without departing from the scope of the invention as defined in the appended claims.

What is claimed is:

1. A light fixture positionable in a recess in a graded environment, the combination comprising:

a housing, located in the recess, having an outer top surface located substantially at grade level and including laterally adjacent, parallel first and second apertures in said outer top surface;

a light-transparent lens coupled to said housing in said first aperture, said lens having an upper outside surface;

a lamp mounted within said housing for directing light upwardly through said lens; and a photocontrol device operatively connected to said lamp for operating said lamp in response to changes in ambient light conditions outside the light fixture, said photocontrol device including a low profile, light-transparent member coupled to said housing in said second aperture, said member having a convex, upwardly directed outer surface including self-flushing means for preventing accumulation of opaque material thereon, said outer surface of said light-transparent member being generally flush with said outside surface of said lens, and a photosensitive switch coupled to said housing for receiving ambient light passing through said light-transparent member and having means for electrically connecting said switch to said lamp.

2. A light fixture as claimed in claim 1 wherein said outer surface of said light-transparent member is conical in shape.

3. A light fixture as claimed in claim 1 wherein said light-transparent member comprises an annular groove and an O-ring fitted within said groove, said O-ring being compressed against said outer surface of said housing when said light-transparent member is coupled to said housing in said second aperture.

4. A light fixture as claimed in claim 1, and further comprising means for sealing said photosensitive switch with respect to said housing.

5. A light fixture as claimed in claim 4 wherein said photosensitive switch comprises a threaded stem and said means for sealing said photosensitive switch comprises a nut threadable on said threaded stem and an O-ring positionable around said threaded stem, said threaded stem being threaded into said second aperture of said housing and said 0-ring being compressed against said housing by said nut threaded along said threaded stem.

6. A light fixture as claimed in claim 5, and further comprising means for sealing said light-transparent member with respect to said housing, said means comprising a second O-ring compressible between said light-transparent member and said housing.

7. A light fixture as claimed in claim 6 wherein said means for sealing said light-transparent member further comprises an annular groove in said member for retaining said second O-ring.

8. A light fixture as claimed in claim 1 wherein an outer surface of said light-transparent member is located substantially at grade level.

9. A light fixture positionable in a recess in a graded environment, the combination comprising:

a housing, located in the recess, having an outer top surface located substantially at grade level and including first and second apertures;

a light-transparent lens coupled to said housing in said first aperture;

a lamp mounted within said housing for directing light through said lens; and a photocontrol device operatively connected to said lamp for operating said lamp in response to changes in ambient light conditions outside the light fixture, said photocontrol device including a light-transparent member coupled to said housing in said second aperture, said member having an outer surface including self-flushing means for preventing accumulation of opaque material thereon, a photosensitive switch coupled to said housing for receiving ambient light passing through said light-transparent member and having means for electrically connecting said switch to said lamp, said photosensitive switch including a threaded stem threaded into said second aperture of said housing, and seal means for sealing said photosensitive switch with respect to said housing, said seal means having a nut threadable on said threaded stem and an O-ring positionable around said threaded stem, said O-ring, being compressed against said housing by said nut threaded along said threaded stem.

10. A light fixture as claimed in claim 9, and further comprising means for sealing said light-transparent member with respect to said housing, said means comprising a second O-ring compressible between said light-transparent member and said housing.

11. A light fixture as claimed in claim 10 wherein said means for sealing said light-transparent member further comprises an annular groove in said member for retaining said second O-ring.

12. A light fixture according to claim 1 wherein said convex outer surface of said light-transparent member has a maximum height above said outer top surface of said housing of less than one-half inch.

13. A light fixture according to claim 1 wherein said light-transparent member comprises an upper portion forming said convex outer surface thereof and extending over said second aperture, and comprises a depending post extending into said second aperture.

14. A light fixture according to claim 13 wherein said post and said second aperture have mating threads.

15. A light fixture according to claim 13 wherein said upper portion comprises a bottom surface opposite said convex outer surfaces and facing said outer top surface of said housing, said post depending from said bottom surface; and an O-ring is located and compressed between said bottom surface and said outer top surface of said housing about said second aperture.

16. A light fixture according to claim 15 wherein said bottom surface comprises an annular groove surrounding said post and receiving said O-ring.

17. A light fixture according to claim 13 where said upper portion has transverse dimensions greater than corresponding transverse dimensions of said second aperture.

18. A light fixture positionable in a recess in a graded environment, the combination comprising:

a housing, located in the recess, having an outer top surface located substantially at grade level and including first and second apertures;

a light-transparent lens coupled to said housing in said first aperture;

a lamp mounted within the housing for directing light through said lens; and a photocontrol device operatively connected to said lamp for operating said lamp in response to changes in ambient light conditions outside the light fixture, said photocontrol device including a light-transparent member coupled to said housing in said second aperture, said member having an upper portion extending over said second aperture with a convex outer surface including self-flushing means for preventing accumulation of opaque material thereon and having a post depending from said upper portion and extending into said second aperture, and a photosensitive switch coupled to said housing for receiving ambient light passing through said light-transparent member and having means for electrically connecting said switch to said lamp.

19. A light fixture according to claim 18 wherein said post and said second aperture have mating threads.

20. A light fixture according to claim 18 wherein said upper portion comprises a bottom surface opposite said convex outer surface and facing said outer top surface of said housing, said post depending from said bottom surface; and an O-ring is located and compressed between said bottom surface and said outer top surface of said housing about said second aperture.

21. A light fixture fixture according to claim 20 wherein said bottom surface comprises an annular groove surrounding said post and receiving said O-ring.

22. A light fixture according to claim 18 where said upper portion has transverse dimensions greater than corresponding transverse dimensions of said second aperture.

23. A light fixture according to claim 18 wherein said photosensitive switch comprises a stem received in said second aperture coaxial to said post.

* * * * *